US011009048B1

(12) United States Patent
Neumann et al.

(10) Patent No.: US 11,009,048 B1
(45) Date of Patent: May 18, 2021

(54) BOOM LIFT SYSTEM

(71) Applicant: Robert Bosch GmbH, Stuttgart (DE)

(72) Inventors: Uwe Neumann, Fountain Inn, SC (US); Enrique Busquets, Fountain Inn, SC (US); Taeho Kim, Simpsonville, SC (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/015,882

(22) Filed: Sep. 9, 2020

(51) Int. Cl.
*F15B 11/16* (2006.01)
*E02F 9/22* (2006.01)

(52) U.S. Cl.
CPC ..... *F15B 11/163* (2013.01); *E02F 9/2221* (2013.01); *E02F 9/2292* (2013.01); *E02F 9/2296* (2013.01); *F15B 11/165* (2013.01); *F15B 2211/20576* (2013.01); *F15B 2211/6346* (2013.01); *F15B 2211/6654* (2013.01)

(58) Field of Classification Search
CPC ..... F15B 11/161; F15B 11/163; F15B 11/165; F15B 11/22; E02F 9/2221; E02F 9/2235
See application file for complete search history.

(56) References Cited

U.S. PATENT DOCUMENTS 4,811,561 A 3/1989 Edwards et al.
5,074,194 A 12/1991 Hirata et al.
5,692,376 A 12/1997 Miki et al.
5,862,663 A 1/1999 Lanza et al.
6,170,262 B1 * 1/2001 Yoshimura ..... E02F 9/2228 60/452
6,305,162 B1 * 10/2001 Cobo ..... E02F 9/2221 60/422
6,336,067 B1 1/2002 Watanabe et al.
6,973,779 B2 12/2005 Naaktgeboren et al.
7,194,855 B2 3/2007 Pfaff
7,434,393 B2 * 10/2008 Hesse ..... E02F 9/2296 60/422
8,483,916 B2 * 7/2013 Peterson ..... F15B 11/165 701/50
9,200,646 B2 * 12/2015 Weickert ..... F15B 11/163
(Continued)

FOREIGN PATENT DOCUMENTS

EP 0519185 A1 12/1992
EP 1188934 A2 3/2002
WO 2012041076 A1 4/2012

*Primary Examiner* — Michael Leslie
(74) *Attorney, Agent, or Firm* — Michael Best & Friedrich LLP

(57) ABSTRACT

A boom lift system includes a primary conduit, a pump-motor arrangement having a motor operable to drive a pump to move a fluid through the primary conduit, first and second actuators in fluid communication with the primary conduit and actuatable in response to first and second user input to perform hydraulic function via the fluid, a valve arrangement configured to control flow of the fluid from the primary conduit to the first and second actuators, and a controller programmed to selectively actuate the valve arrangement in response to the first and second user inputs. When the controller receives both of the inputs, the valve arrangement is actuated by the controller to vary the flow rate of fluid to each of the first and second actuators. When the controller receives only one of the first input or the second input, the controller varies a flow rate output of the pump.

20 Claims, 8 Drawing Sheets

(56) References Cited

U.S. PATENT DOCUMENTS

| | | | | |
|---|---|---|---|---|
| 9,234,532 | B2 | 1/2016 | Vanderlaan et al. | |
| 9,303,387 | B2 | 4/2016 | Pfaff et al. | |
| 9,346,207 | B2 | 5/2016 | Yuan | |
| 9,631,455 | B2 | 4/2017 | Geiger et al. | |
| 9,719,530 | B2 | 8/2017 | Specks et al. | |
| 9,803,748 | B2 | 10/2017 | Hendrix et al. | |
| 9,903,394 | B2 | 2/2018 | Brahmer | |
| 10,267,343 | B2 * | 4/2019 | Veit | E02F 9/2292 |
| 2019/0119934 | A1 | 4/2019 | Vierkotten et al. | |
| 2019/0161983 | A1 | 5/2019 | Henikl et al. | |

* cited by examiner

BOOM LIFT SYSTEM

BACKGROUND

The present disclosure relates to a hydraulic system. More particularly, the present disclosure relates to a boom lift system that operates with multiple inputs to control multiple actuators.

SUMMARY

In one aspect, a boom lift system includes a primary conduit, a pump-motor arrangement having a motor operable to drive a pump to move a fluid through the primary conduit, a first actuator in fluid communication with the primary conduit and actuatable in response to a first user input to perform a first hydraulic function via the fluid, a second actuator in fluid communication with the primary conduit and actuatable in response to a second user input to perform a second hydraulic function via the fluid, a valve arrangement configured to control flow of the fluid from the primary conduit to the first and second actuators, and a controller programmed to selectively actuate the valve arrangement in response to the first and second user inputs. When the controller receives both of the first input and the second input, the valve arrangement is actuated by the controller to vary the flow rate of fluid to each of the first and second actuators. When the controller receives only one of the first input or the second input, the valve arrangement is not actuated to vary the flow rate of fluid and the controller varies a flow rate output of the pump.

In another aspect, a boom lift system includes a first actuator operable to perform a first hydraulic function, a second actuator operational in parallel with the first actuator to perform a second hydraulic function, a pump-motor arrangement having a motor operable to drive a pump to provide a fluid to the first actuator and the second actuator, the pump-motor arrangement configured to provide a controlled, variable flow rate of the fluid to the first actuator or the second actuator when only one of the first actuator or the second actuator are actuated, and a valve arrangement configured to provide a controlled, variable flow rate of the fluid from the pump to the first and second actuators when both of the first actuator and the second actuator are actuated.

In yet another aspect, a boom lift system includes a plurality of actuators including a first actuator operable in response to a first input and a second actuator operable in response to a second input, a pump-motor arrangement having a motor operable to drive a pump to move a fluid through a primary conduit to the first actuator and to the second actuator, a decentralized valve arrangement having a first valve located adjacent the first actuator and a second valve located adjacent the second actuator, wherein the first valve is spaced apart from the second valve and both of the first valve and the second valve are spaced apart from the pump-motor arrangement, and a controller programmed to receive a first signal indicative of the first input and a second signal indicative of the second input, the controller further programmed to control a different one of the pump-motor arrangement or the decentralized valve arrangement to vary a flow of fluid to the first and/or second actuator based upon whether only one or both of the first and second inputs are received.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
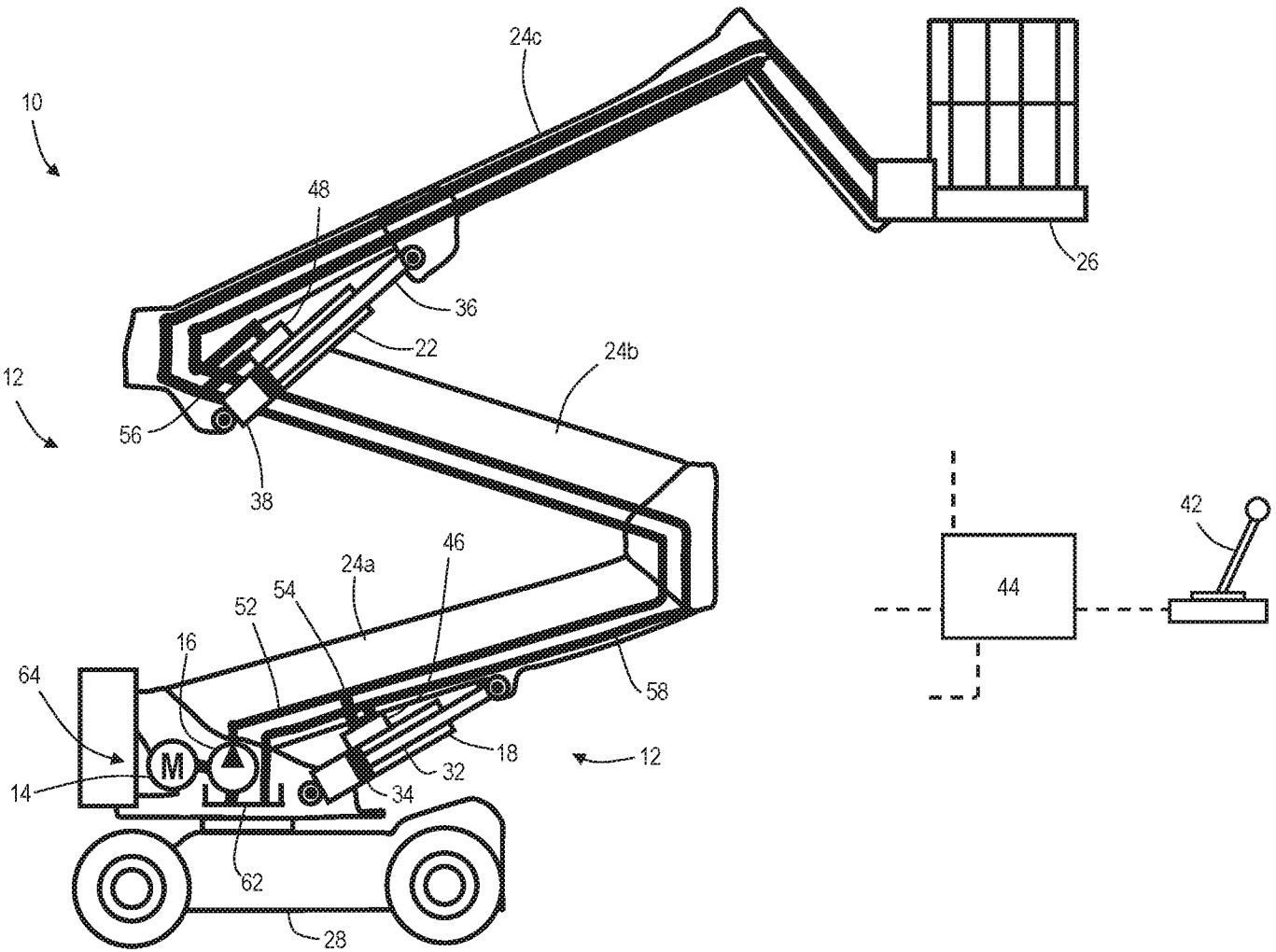
FIG. 1 is a schematic side view of a boom lift system.

FIG. 1 illustrates a boom lift system 10 having a decentralized valve arrangement 12, a pump-motor arrangement 64 (including a motor 14 and a pump 16), and actuators 18, 22. These elements are additionally shown schematically in FIGS. 2 and 3. With continued reference to FIG. 1, the actuators 18, 22, are mounted to structural extensions or beams 24*a*, 24*b*, 24*c* (e.g., mast, boom, etc.) of the boom lift system 10 at various joints to move (e.g., rotate, extend) the different beams 24*a*, 24*b*, 24*c* relative to one another under hydraulic power, thereby repositioning a work platform or lift 26 into different positions relative to a base 28. The boom-lift system 10 is a hybrid throttle-less control system. For a single actuator control, the system 10 works as a pure throttle-less control system. For multi-actuator control, the system distributes flow to multiple unevenly loaded actuators 18, 22 via proportional directional valve compensation based on inertial measurement units.

As shown, the first actuator 18 is a linear actuator having a piston 32 positioned within a cylinder 34. Linear actuation of the first actuator 18 generates rotation of the lower extension 24*a* relative to the base 28. Due to the dual parallelogram structure of the lower and middle extensions 24*a*, 24*b* of the articulated boom system 10, there is only vertical motion at the upper extension 24*c* and lift 26. If the boom lift system 10 is otherwise a telescopic boom system, actuation of the first actuator 18 may additionally rotate the upper extension 24*c* and the lift 26 relative to the lower extension 24*a* and the base 28, as the upper extension 24*c* and lift 26 are fixed to the middle extension 24*b*. However, this rotation can be countered by additionally actuating the second actuator 22.

The second actuator 22 is a linear actuator similar to the first actuator 18, having a piston 36 movable within a cylinder 38. In contrast to the first actuator 18, the second actuator 22 is located at a joint between the middle and upper extensions 24*b*, 24*c*, and is therefore spaced apart from the first actuator 18 along the length of the boom lift system 10. The second actuator instead rotates the upper extension 24*c* and lift 26 relative to the middle extension 24*b*, the lower extension 24*a*, and the base 28. Additional actuators may be located at various locations along the boom lift system 10, for example, for rotating the lift 26 relative to the upper extension 24*c*, or for telescopically extending one of the extensions 24*a*, 24*b*, 24*c* to modify the height and reach of the boom lift system 10. The linear actuators 18, 22 are driven via hydraulic fluid as described in greater detail below.

A user controls movement of the boom lift system 10 via a human machine interface (HMI) 42. The HMI 42 is an input device such as a physical input device (e.g., lever, joystick, dial) or an electronic input for entering a command to actuate one or more of the actuators 18, 22. In some embodiments, the input device 42 includes only one device (e.g., multi-directional joystick, electronic input) that controls actuation of both actuators 18, 22. In other embodiments, the input device 42 may include a plurality of individual devices (e.g., two levers or joysticks), each associated with one of the actuators 18, 22 and usable together to concurrently or separately control the actuators 18, 22.

The HMI 42 allows a user to modify the magnitude of the input to achieve a variable speed control of the actuators 18, 22. In order to vary or modify the speed of the actuator 18, 22, the input provided by the user is converted to a signal and interpreted by a controller 44, resulting in a control of the flow rate in the hydraulic system, as described in greater detail below. As shown, the controller 44 includes a machine controller 44A and a separate motor controller 44B. In other embodiments, a single controller may be utilized.

Figure 3:
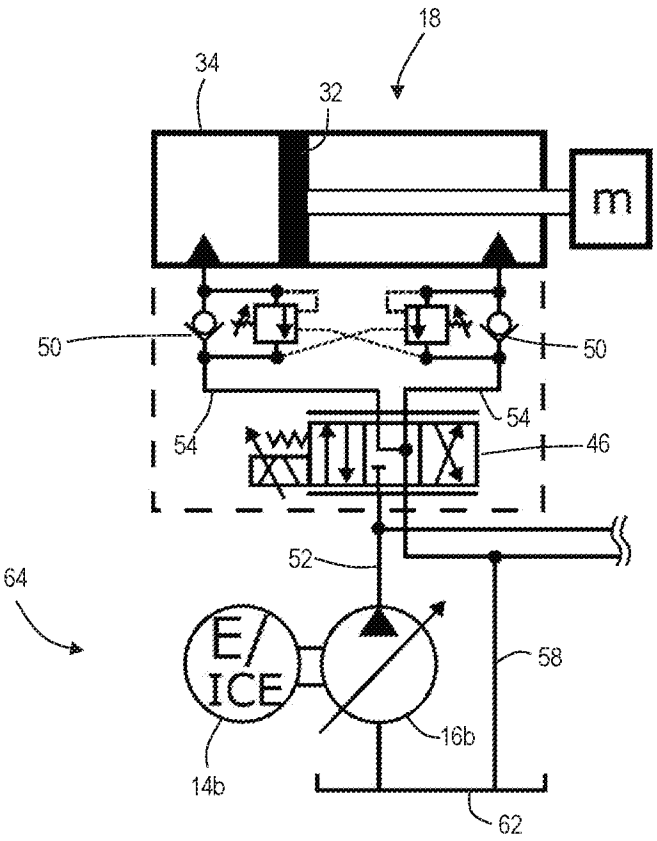
FIG. 3 is a schematic representation of a single actuator of the boom lift system in combination with a variable displacement pump.
Figure 2:
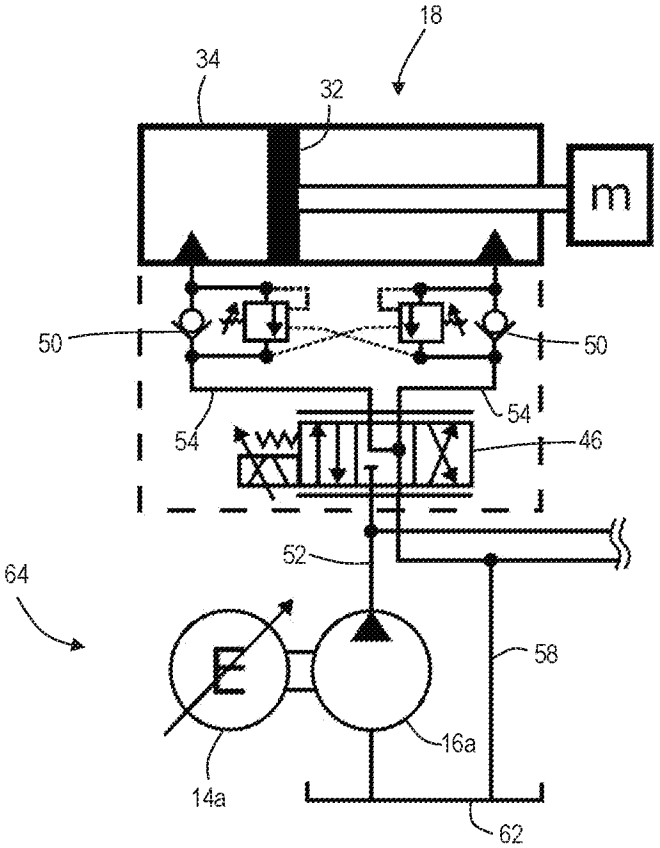
FIG. 2 is a schematic representation of a single actuator of the boom lift system in combination with a variable speed motor.

The valve arrangement 12 shown includes a first valve 46 and a second valve 48, and the first valve 46 is shown in greater detail in FIGS. 2-3. The arrangement shown for the first valve 46 in FIGS. 2-3 is similar to the arrangement for the second valve 48. The first and second valves 46, 48 are directional valves. In some embodiments, the first and second valves 46,48 are proportional directional valves. The first valve 46 is associated with the first actuator 18 to selectively control fluid flow (e.g., flow rate) to and from the first actuator 18. Similarly, the second valve 48 is associated with the second actuator 22 to selectively control fluid flow (e.g., flow rate) to and from the second actuator 22. The valve arrangement 12 is decentralized such that the first valve 46 is located adjacent to the first actuator 18 and the second valve 48 is located adjacent to the second actuator 22. The first valve 46 is spaced apart from the second valve 48 (e.g., the first valve 46 is spaced as far from the second valve 48 as the first actuator 18 is spaced from the second actuator 22). As shown in FIGS. 2-5, the valve arrangements 12 may further include counter balance valves 50 (that each include a check valve and pilot operated valve) for controlling the direction of flow and preventing an undesired reversal of flow from the actuator 18 to the directional valve 46.

A primary conduit 52 extends from the pump 16 to the first valve 46 and to the second valve 48. As shown, the first and second valves 46, 48 are in parallel. The primary conduit 52 branches off into secondary conduits 54, 56 at the valves 46, 48. In this way, only a single, common conduit 52 provides fluid from the pump 16 to each of the actuators 18, 22. A return conduit 58 runs in parallel with the primary conduit 52 and similarly branches off at the valves 18, 22 to provide a return path for fluid to return to a reservoir 62.

In contrast to the decentralized valve arrangement 12, a centralized valve arrangement utilizes a central manifold having a plurality of hydraulic hoses, each pair of hoses (one fluid delivery hose, one fluid return hose) extending to a different actuator. The valving and control of fluid provided to the different actuators takes place at the central manifold. Such a system requires substantially more hoses and a bulky central manifold that can be eliminated or reduced in size/number via a decentralized system.

Figure 4:
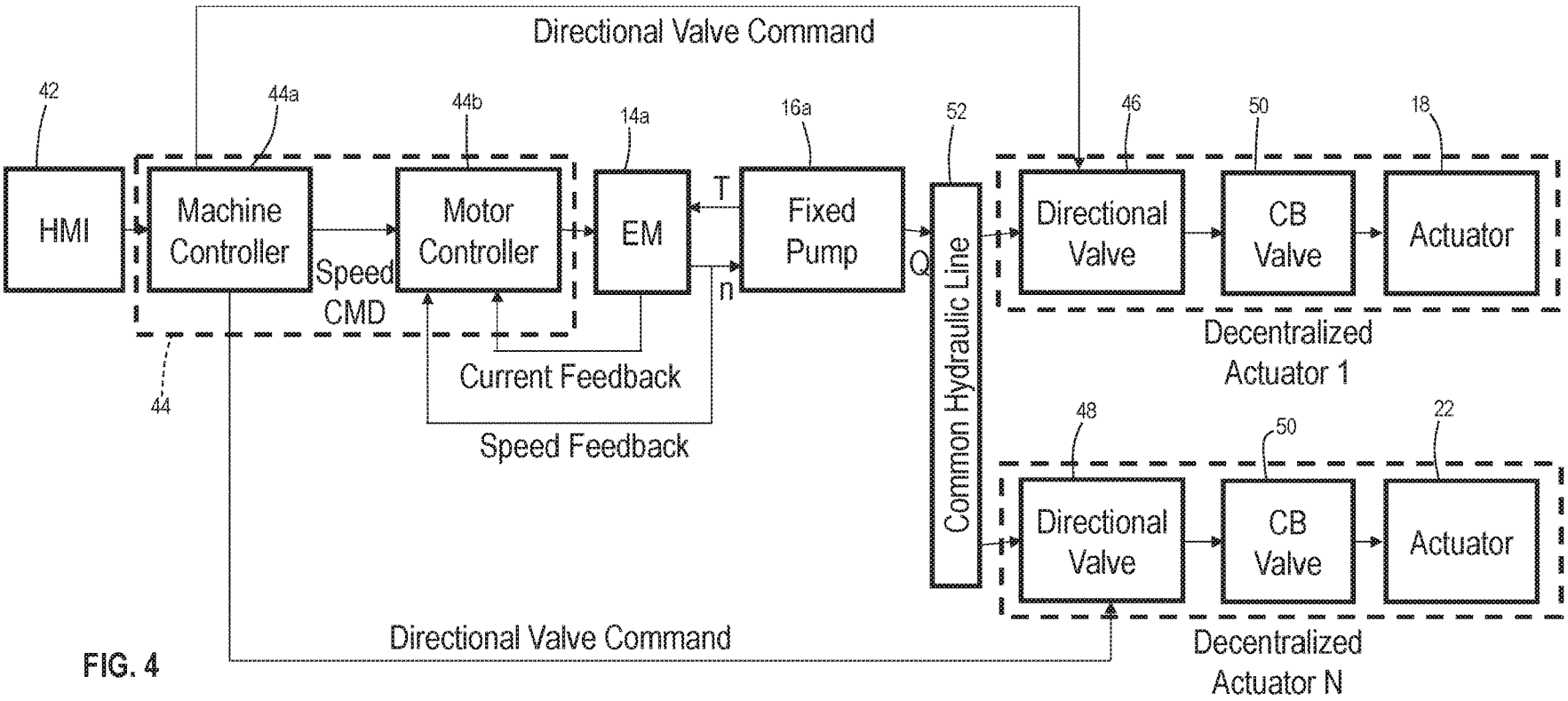
FIG. 4 is a schematic representation of the boom lift system having a variable speed motor.

The pump 16 is powered by the motor 14 to deliver the hydraulic fluid from the reservoir 62 to the valve arrangement 12 and actuators 18, 22. In some embodiments, as shown in FIG. 2, the motor 14 is a variable speed motor 14*a*. The variable speed motor 14*a* is adjustable to vary the speed of its output shaft (connected to the pump 16), thereby also varying the speed of the pump 16. A fixed displacement pump 16*a* can be used in combination with the variable speed motor 14*a* to generate a variable outlet flow rate from the pump 16. Further, as shown in FIG. 4, the motor controller 44*b* utilizes speed and current feedback to generate a speed command to control the speed of the motor 14*a*.

Figure 5:
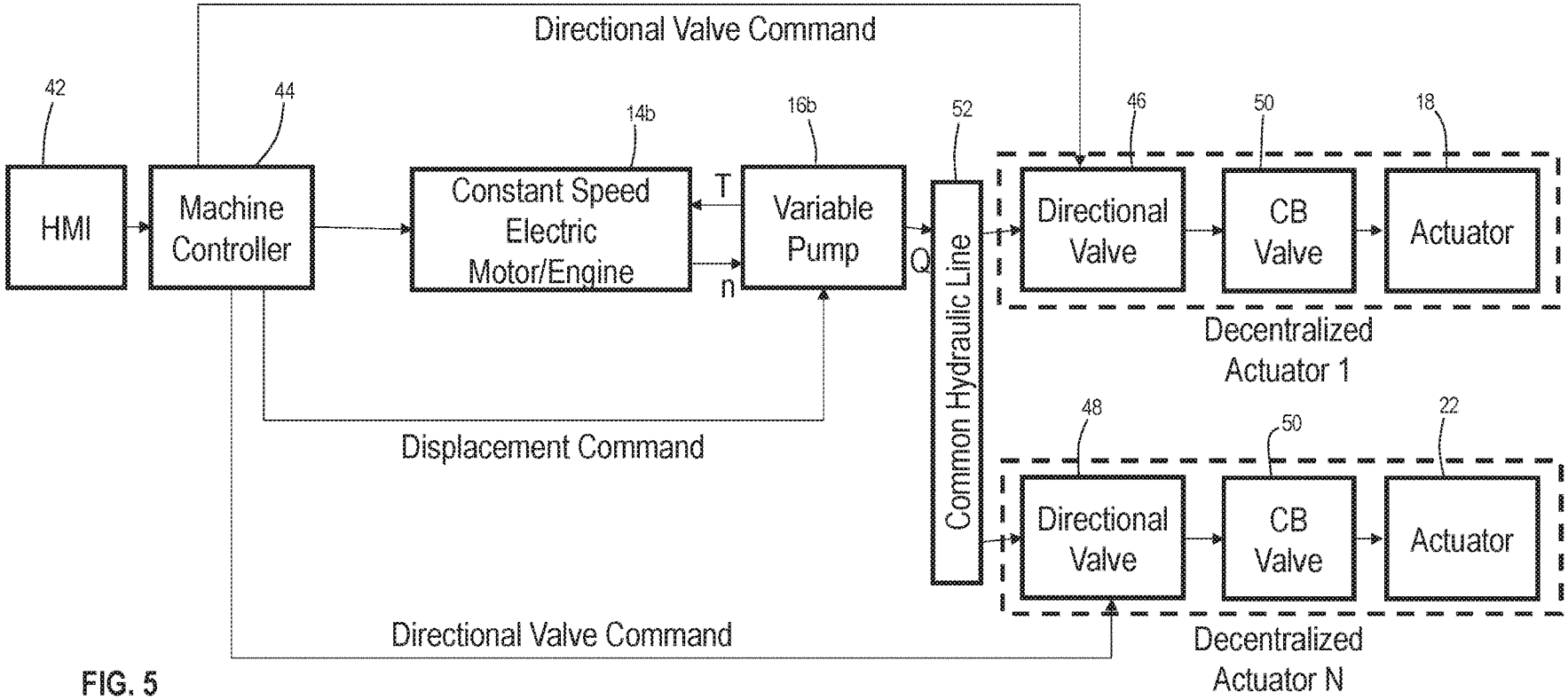
FIG. 5 is a schematic representation of the boom lift system having a variable displacement pump.

In other embodiments, as shown in FIG. 3, the pump 16 is a variable displacement pump 16*b* (e.g., axial piston pump, bent axis pump) having a swash plate that is movable to adjust the output of the pump 16*b* without necessitating a change in the speed of the motor 14. Therefore, a fixed speed motor 14*b* can be used in combination with the variable displacement pump 16*b* to generate a variable outlet flow rate from the pump 16. Further, as shown in FIG. 5, the machine controller 44 provides a displacement command to the variable displacement pump to adjust the flow output of the pump.

Figure 10:
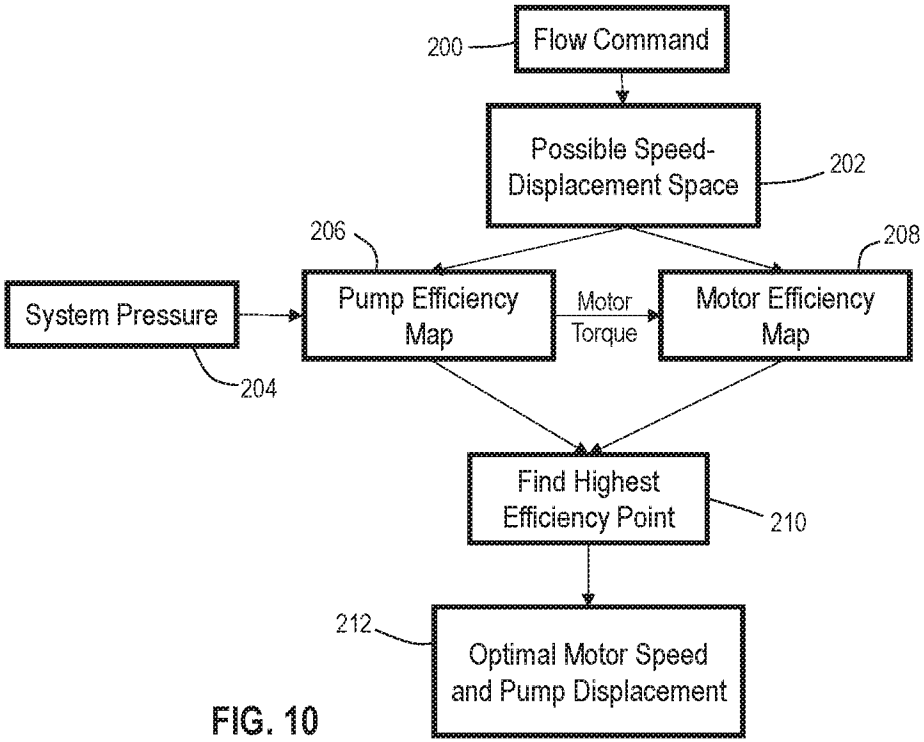
FIG. 10 is a control diagram of the boom lift system having a variable speed motor and a variable displacement pump.

In still a further embodiment, a variable speed motor 14 may be used in combination with a variable displacement pump 16 to provide a larger range of available pump flow rates and/or higher efficiency. When using a variable speed motor 14 and variable displacement pump 16, multiple combinations of rotational speed and pump displacement are available for a constant delivery flow output. FIG. 10 illustrates a flow chart for determining control with high efficiency when the system includes both a variable speed motor 14 and variable displacement pump 16. The controller 44 receives a flow command from the input device 42 at step 200. The controller 44 analyzes the possible speed-displacement space (step 202) and the system pressure (step 204) in view of a pump efficiency map 206 to determine an efficient pump efficiency. The controller 44 further analyzes a motor efficiency map 208 in view of the pump efficiency 206 and motor torque. The controller 44 determines the highest efficiency point 210 for the pump 16 and motor 14 based on the above inputs and generates signals for controlling the motor speed and pump displacement (step 212) to operate the pump 16 and motor 14 at high efficiency.

In embodiments utilizing a variable displacement pump 16*b* and/or a variable speed motor 14*a*, the output of the pump 14 can be modulated to provide a variable outlet flow rate to the actuators 18, 22. Therefore, when a user controls the HMI 42, the pump-motor arrangement 64 is controllable to modify the flow rate to the primary conduit 52 and the valve arrangement 12 is further selectively controllable to modify the flow rate from the primary conduit 52 to the actuators 18, 22. As such, both of the pump-motor arrangement 64 and the valve arrangement 12 are capable of providing a controlled, variable flow rate of hydraulic fluid to the actuators 18, 22.

In operation, a user controls the HMI 42 to provide an input for a desired actuator 18, 22 (or multiple actuators 18, 22 concurrently). The HMI 42 provides a signal indicative of the user input to the controller 44. The controller 44 analyzes the input and controls the boom lift system 10 based on the input. If the user input analyzed by the controller 44 indicates that only a single actuator 18, 22 is to be actuated, the controller operates the valve arrangement 12 and pump-motor arrangement 64 in a first mode. If the user input indicates that a plurality of actuators 18, 22 are to be actuated, the controller operates the valve arrangement 12 and the pump-motor arrangement 64 in a second mode.

Figure 7:
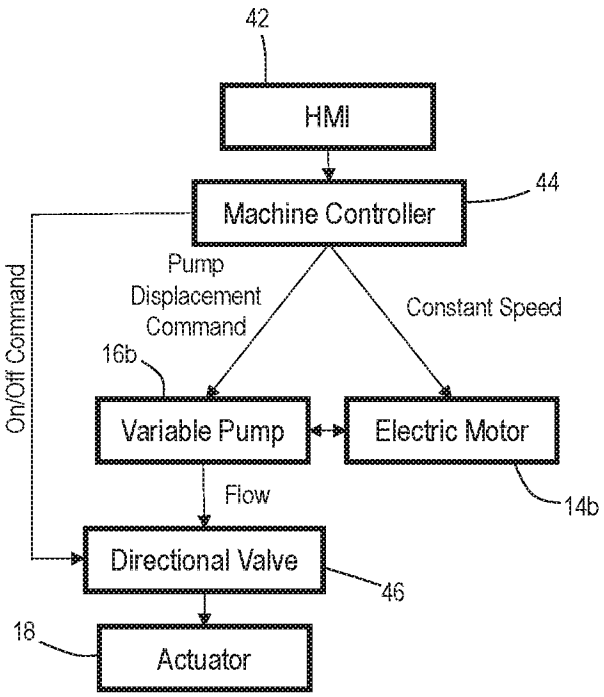
FIG. 7 is a control diagram of the boom lift system having a variable displacement pump.
Figure 6:
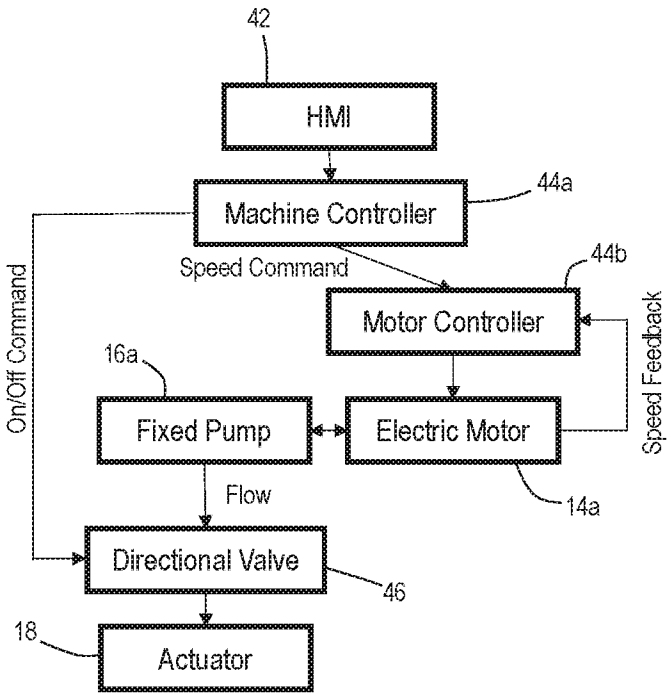
FIG. 6 is a control diagram of the boom lift system having a variable speed motor.

In the first mode of operation, when the user inputs a command to control only a single actuator (for example, here, only the first actuator 18), the controller 44 provides a signal to open and/or close valves 46, 48 of the valve arrangement 12 but does not control the valves 46, 48 of the valve arrangement 12 to modify the flow rate of fluid as shown in FIGS. 6-7. Closing off the second valve 48 effectively removes the second actuator 22 from the active system as it no longer receives fluid from the pump-motor arrangement 64. If the valves 46, 48 of the valve arrangement 12 are normally closed valves, the controller 44 opens the first valve 46 and leaves the second valve 48 in its biased closed state. If the valves 46, 48 of the valve arrangement 12 are normally open valves, the controller 44 closes the second valve 48 and leaves the first valve 46 in its biased open state.

With the valves 46, 48 arranged to correctly direct fluid flow from the primary conduit 52 to the correct actuator 18, the controller 44 controls the pump-motor arrangement 64 to modulate an outlet flow rate from the pump 16 based on the magnitude of the input provided by the user at the HMI 42. The magnitude of the output flow rate of the pump 16 is adjustable to compensate for adjustments made at the HMI 42 by modulating the displacement of the pump 16 (if it is a variable displacement pump 16*b*) or the speed of the motor 14 (if it is a variable speed motor 14*a*). As such, full control of the variable flow rate generated by the pump 14 in the first mode of operation is provided by controlling the pump-motor arrangement 64. When the operation is completed, the actuated valve 46, 48 is returned to its biased position and the pump-motor arrangement 64 is deenergized.

In the second mode of operation, when the user inputs a command to control a plurality of actuators (for example, here, both the first and second actuators 18, 22), the controller 44 controls the valve arrangement 12 to provide a controlled, variable flow rate to each actuator 18, 22 based on the corresponding user input to the HMI 42. For example, if the user enters a first input for a slow actuation of the first actuator 18 and a concurrent second input for a fast actuation of the second actuator 22, the motor 14 drives the pump 16 to provide a fluid output that is high enough to accommodate both inputs, and the valves 46, 48 are opened to varying degrees based on the magnitude of the first and second inputs. In the specified example, the second valve 48 is opened a greater amount than the first valve 46 to provide a greater flow rate of fluid from the pump 16 to the second actuator 22 than the first actuator 18. The pump-motor arrangement 64 may be controlled based on the inputs to vary the output flow rate to the valve arrangement 12. Alternatively, as the valves 46, 48 modulate the flow rate to the respective actuators 18, 22, the pump-motor arrangement may otherwise operate at a predefined rate or speed that is great enough to accommodate any input at the HMI 42.

Figure 8:
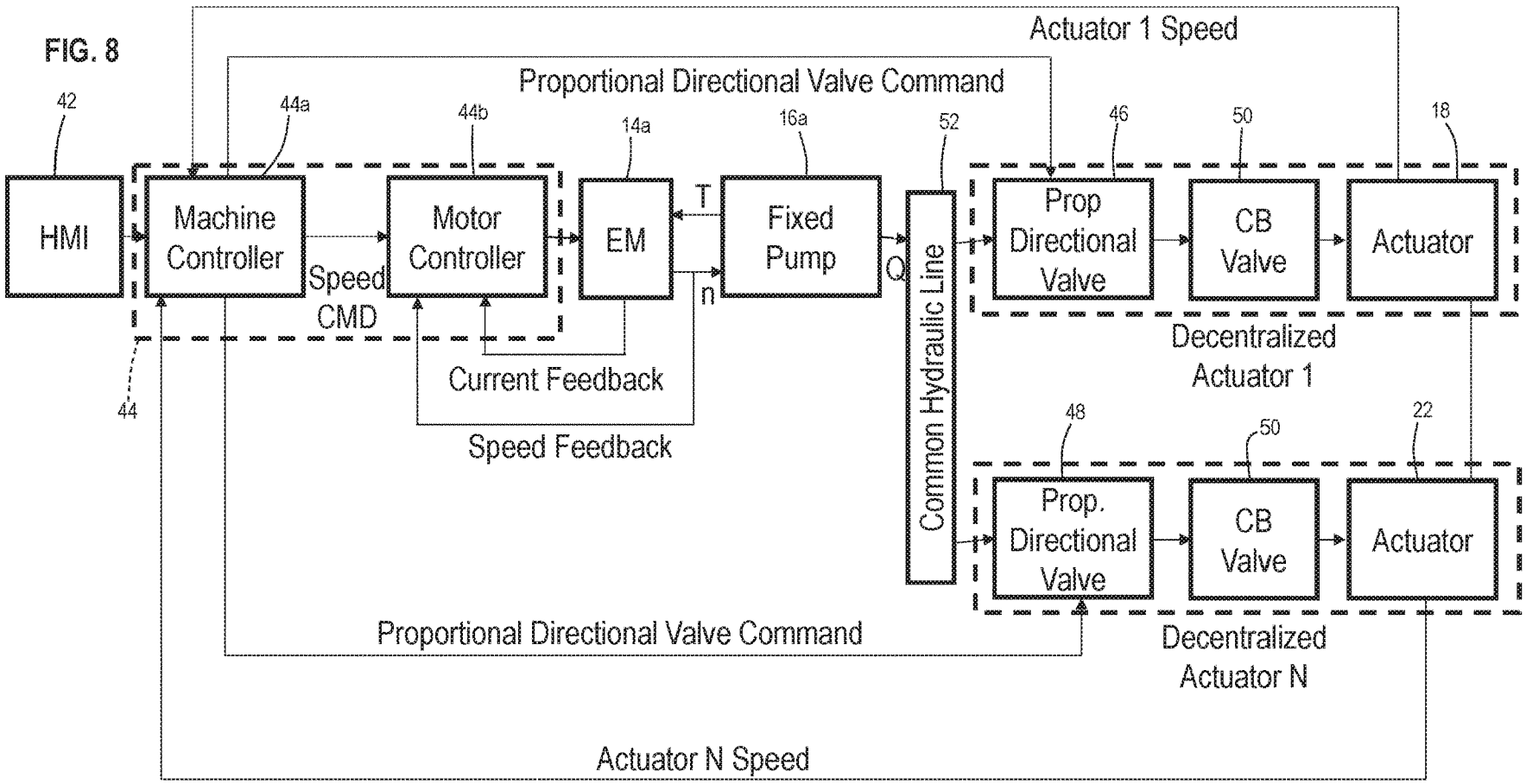
FIG. 8 is a schematic representation of the boom lift system utilizing a flow sharing functionality.

In the second mode of operation, the boom lift system 10 operates under an electronic flow sharing functionality. The electronic flow sharing functionality handles multiple actuators with uneven loads utilizing an electronic compensation of the proportional directional valves 46, 48 as shown in FIG. 8. The electronic compensation reduces the valve stroke of a lightly loaded actuator and makes the actuator move together with heavily loaded actuators. The functionality calculates a proper valve spool stroke adjustment based on the actuator speed feedback from inertial measurement units (IMUs) located at each actuator 18, 22. The functionality also regulates pump output flow based on the desired actuator flow of the multiple actuators 18, 22. This generates simultaneous movements of the heavy lower lift cylinder 18 and the light upper lift actuator 22 without using additional hydraulic flow compensators.

Figure 9:
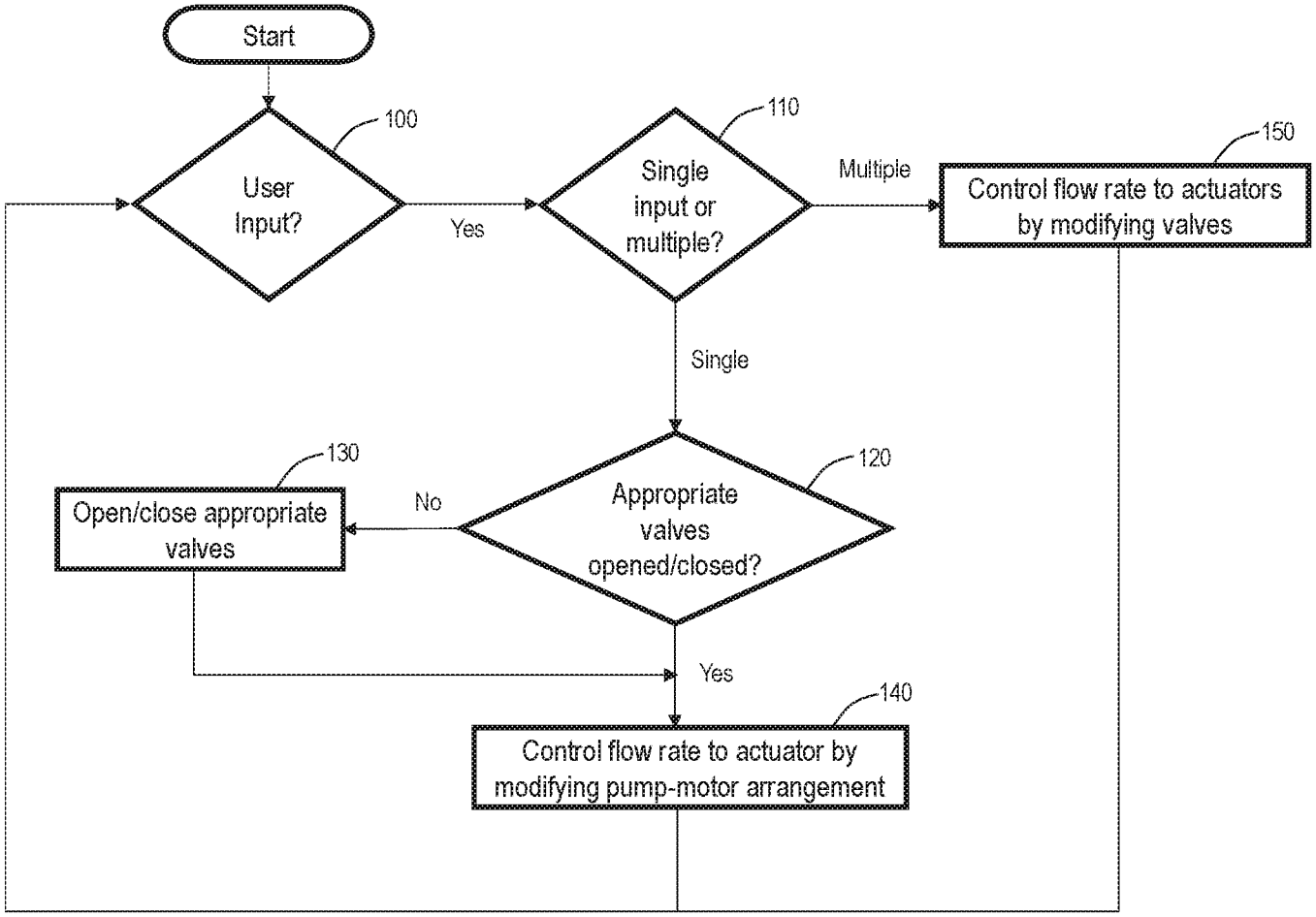
FIG. 9 is a flowchart depicting paths for first and second modes of operation.

FIG. 9 is a flow chart depicting paths for the first and second modes of operation. At a first decision 100, the controller 44 determines whether a user input has been recorded. If a user input has been entered via the HMI, a second decision 110 asks if the input was for a single actuator 18, 22 or multiple actuators 18, 22. If the signal indicates that the user input is for only a single actuator, a third decision 120 asks if the appropriate valves 46,48 are open or closed. If not, the controller 44 sends a signal to the valves 46, 48 to open or close as necessary at step 130 so that the flow from the pump 16 is directed to the correct actuator 18, 22. Then, at step 140, the controller 44 controls the flow rate from the pump by modifying the pump-motor arrangement 64, as described in greater detail above with respect to the first mode of operation. If, instead, the signal indicates that the user input is for multiple actuators 18, 22, the controller 44 controls the flow rate to the actuators 18, 22 at step 150 by modifying the valves 46, 48 as described above with respect to the second mode of operation.

In the first and second modes of operation, the controller 44 continues to monitor the input at the HMI 42, even as the pump-motor arrangement 64 and valve arrangement 12 are actuated. Any changes to the input are identified by the controller 44, allowing the controller 44 to adjust control of the flow rate to the actuators 18, 20.

Various features of the disclosure are set forth in the following claims.

The invention claimed is:

1. A boom lift system comprising:

a primary conduit;

a pump-motor arrangement having a motor operable to drive a pump to move a fluid through the primary conduit;

a first actuator in fluid communication with the primary conduit and actuatable in response to a first user input to perform a first hydraulic function via the fluid;

a second actuator in fluid communication with the primary conduit and actuatable in response to a second user input to perform a second hydraulic function via the fluid;

a valve arrangement configured to control flow of the fluid from the primary conduit to the first and second actuators; and a controller programmed to selectively actuate the valve arrangement in response to the first and second user inputs, wherein, when the controller receives both of the first input and the second input, the valve arrangement is actuated by the controller to vary the flow rate of fluid to each of the first and second actuators, and wherein, when the controller receives only one of the first input or the second input, the valve arrangement is not actuated to vary the flow rate of fluid and the controller varies a flow rate output of the pump.

2. The boom lift system of claim 1, wherein the primary conduit extends from the pump-motor arrangement to a first valve of the valve arrangement and from the first valve to a second valve of the valve arrangement.

3. The boom lift system of claim 2, wherein the first valve is located adjacent the first actuator and the second valve is located adjacent the second actuator, wherein the first valve is spaced apart from the second valve and both of the first valve and the second valve are spaced apart from the pump-motor arrangement.

4. The boom lift system of claim 1, wherein the pump is a variable displacement pump such that the displacement of the pump is adjustable to vary the flow rate output of the pump.

5. The boom lift system of claim 1, wherein the motor is a variable speed motor such that the speed of the motor is adjustable to vary the flow rate output of the pump.

6. The boom lift system of claim 1, wherein the pump is a variable displacement pump and the motor is a variable speed motor such that the displacement of the pump and the speed of the motor are adjustable to vary the flow rate output of the pump.

7. The boom lift system of claim 1, wherein, when the controller receives both of the first input and the second input, the controller actuates a first valve of the valve arrangement proportional to the first input and the controller actuates a second valve of the valve arrangement proportional to the second input.

8. The boom lift system of claim 7, wherein, when the controller receives only one of the first input or the second input, the controller varies the flow rate output of the pump proportional to the only one of the first input or the second input.

9. The boom lift system of claim 1, wherein, when the controller receives both of the first input and the second input, the flow rate output of the pump is substantially constant.

10. The boom lift system of claim 1, further comprising an input device actuatable by an operator to generate the first input and the second input and to independently adjust the magnitude of the first input and the second input.

11. A boom lift system comprising:

a first actuator operable to perform a first hydraulic function;

a second actuator operational in parallel with the first actuator to perform a second hydraulic function;

a pump-motor arrangement having a motor operable to drive a pump to provide a fluid to the first actuator and the second actuator, the pump-motor arrangement configured to provide a controlled, variable flow rate of the fluid to the first actuator or the second actuator when only one of the first actuator or the second actuator are actuated; and a valve arrangement configured to provide a controlled, variable flow rate of the fluid from the pump to the first and second actuators when both of the first actuator and the second actuator are actuated.

12. The boom lift system of claim 11, wherein a primary conduit extends from the pump-motor arrangement to a first valve of the valve arrangement and from the first valve to a second valve of the valve arrangement.

13. The boom lift system of claim 12, wherein the valve arrangement is a decentralized valve arrangement such that the first valve is located adjacent the first actuator and the second valve is located adjacent the second actuator, wherein the first valve is spaced apart from the second valve and both of the first valve and the second valve are spaced apart from the pump-motor arrangement.

14. The boom lift system of claim 11, wherein the pump-motor arrangement includes at least one of a variable displacement pump or a variable speed motor to vary the controlled, variable flow rate when only one of the first actuator or the second actuator are actuated.

15. The boom lift system of claim 11, further comprising a controller programmed to selectively control the pump-motor arrangement and the valve arrangement in response to user inputs at an input device.

16. A boom lift system comprising:

a plurality of actuators including a first actuator operable in response to a first input and a second actuator operable in response to a second input;

a pump-motor arrangement having a motor operable to drive a pump to move a fluid through a primary conduit to the first actuator and to the second actuator;

a decentralized valve arrangement having a first valve located adjacent the first actuator and a second valve located adjacent the second actuator, wherein the first valve is spaced apart from the second valve and both of the first valve and the second valve are spaced apart from the pump-motor arrangement; and a controller programmed to receive a first signal indicative of the first input and a second signal indicative of the second input, the controller further programmed to control a different one of the pump-motor arrangement or the decentralized valve arrangement to vary a flow of fluid to the first and/or second actuator based upon whether only one or both of the first and second inputs are received.

17. The boom lift system of claim 16, wherein the controller is programmed to control the pump-motor arrangement when the only one of the first or second inputs are received, and wherein the controller is programmed to control the decentralized valve arrangement when both of the first and second inputs are received.

18. The boom lift system of claim 16, wherein the decentralized valve arrangement is not controlled to vary the flow rate of fluid when the only one of the first or second inputs are received.

19. The boom lift system of claim 16, wherein the controller is programmed to actuate the first actuator in proportion to a magnitude of the first signal and to actuate the second actuator in proportion to a magnitude of the second signal.

20. The boom lift system of claim 16, further comprising a primary conduit common to both of the plurality of actuators such that the primary conduit extends between the pump-motor arrangement and the plurality of actuators.

* * * * *